US008844479B2

(12) United States Patent
Hiyoshi

(10) Patent No.: US 8,844,479 B2
(45) Date of Patent: Sep. 30, 2014

(54) VARIABLE COMPRESSION RATIO ENGINE

(71) Applicant: Nissan Motor Co., Ltd., Yokohama (JP)

(72) Inventor: Ryosuke Hiyoshi, Isehara (JP)

(73) Assignee: Nissan Motor Co., Ltd., Yokohama-Shi, Kanagawa (JP)

( * ) Notice: Subject to any disclaimer, the term of this patent is extended or adjusted under 35 U.S.C. 154(b) by 0 days.

(21) Appl. No.: 13/858,273

(22) Filed: Apr. 8, 2013

(65) Prior Publication Data

US 2013/0327302 A1 Dec. 12, 2013

(30) Foreign Application Priority Data

Jun. 6, 2012 (JP) ..... 2012-128512

(51) Int. Cl.
*F02B 75/04* (2006.01)

(52) U.S. Cl.
CPC ..... *F02B 75/04* (2013.01); *F02B 75/048* (2013.01)
USPC ..... 123/48 R; 123/48 A; 123/78 R

(58) Field of Classification Search
CPC ..... F02B 75/048; F02B 75/045; F02B 75/047
USPC .... 123/48 A, 48 R, 48 AA, 78 R, 78 A, 78 B, 123/78 E, 48 B
See application file for complete search history.

(56) References Cited

U.S. PATENT DOCUMENTS

| | | | | |
|---|---|---|---|---|
| 4,917,066 | A * | 4/1990 | Freudenstein et al. | 123/48 B |
| 6,647,935 | B2 * | 11/2003 | Aoyama et al. | 123/90.16 |
| 7,681,538 | B2 * | 3/2010 | Hiyoshi et al. | 123/48 B |
| 2003/0019448 | A1 * | 1/2003 | Aoyama et al. | 123/90.16 |
| 2004/0083992 | A1 * | 5/2004 | Nohara et al. | 123/78 E |
| 2004/0163614 | A1 | 8/2004 | Hiyoshi et al. | |
| 2008/0223341 | A1 * | 9/2008 | Kamada | 123/48 B |
| 2008/0283008 | A1 * | 11/2008 | Hiyoshi et al. | 123/90.17 |
| 2008/0283027 | A1 * | 11/2008 | Meintschel et al. | 123/48 B |
| 2009/0019448 | A1 * | 1/2009 | Bouge et al. | 718/104 |
| 2010/0192915 | A1 * | 8/2010 | Tanaka et al. | 123/48 B |

* cited by examiner

*Primary Examiner* — Noah Kamen
*Assistant Examiner* — Long T Tran
(74) *Attorney, Agent, or Firm* — Young Basile

(57) ABSTRACT

In a variable compression ratio engine with a connecting mechanism including a first control shaft to control the compression ratio of a variable compression ratio, a second control shaft to be rotated/retained by an actuator, and a lever interconnecting the first control shaft and the second control shaft, a speed reduction ratio from the actuator to the first control shaft through the rotation power transmission path is set to be maximum at the maximum compression ratio, at a preset compression ratio (i.e. at any given compression ratio between the minimum compression ratio and the maximum compression ratio) the speed reduction ratio is set to be minimum, and the reduction ratio is set higher at the maximum compression ratio as compared to the intermediate compression ratio.

8 Claims, 11 Drawing Sheets

Low comp. ratio,
obtuse angle θ3

High comp. ratio,
acute angle θ

VARIABLE COMPRESSION RATIO ENGINE

CROSS-REFERENCE TO RELATED APPLICATIONS

This application claims priority under 35 U.S.C. §119 to Japanese Patent Application No. 2012-128512. The entire disclosure of Japanese Patent Application No. 2012-128512 is hereby incorporated herein by reference.

FIELD OF TECHNOLOGY

The present invention generally relates to an internal combustion engine with a variable compression ratio mechanism capable of varying or changing the compression ratio of the engine.

BACKGROUND

A variable compression ratio mechanism capable of changing the compression ratio by using a piston-crank mechanism has been proposed such as disclosed in U.S. Patent Application Publication, No. 2004/0163614 A1. Such a variable compression ratio mechanism is constructed to control the compression ratio of the engine by changing the rotation position of a first control shaft by an actuator such as a motor in accordance with the engine operating condition.

In a structure in which the actuator for the variable compression ratio is placed outside the engine body to protect against oil, exhaust heat or the like, for example, an actuator and a first control shaft are coupled by a coupling mechanism while a first arm portion of the first control shaft disposed inside of the engine body and a second arm of a second control shaft disposed outside of the engine body are coupled by a lever extending through a side wall of the engine body. A second control shaft is accommodated in and attached to a housing attached to the side wall of the engine body, and an actuator such as an electric motor or the like is attached to the housing.

In the variable compression ratio internal combustion engine of such structure, by changing the rotation angle of the first control shaft, the compression ratio of engine is changed while, because of the change in posture of the first and second arm portions and a lever coupling the first arm portion and the second arm portion, the speed reduction ratio through a rotation power transmission path or line from the actuator to the first control shaft i.e. total reduction ratio is also changed.

BRIEF SUMMARY

According to the present invention, the relationship between the engine compression ratio and speed reduction ratio, both of which are subject to change in accordance with the rotation angle of the first control shaft is optimized and thereby a new internal combustion engine with a compression ration mechanism is provided. For example, by increasing the speed reduction ratio at setting of a given engine compression ratio, the rotation angle of the control shaft is retained and thereby retentions of engine compression ratio may be improved. Further, at another setting of engine compression ratio, by decreasing the speed reduction ratio, a change rate or speed in rotation angle of the first control shaft may be enhanced, and thus the responsiveness of the engine compression ratio may be improved.

The variable compression ratio engine according to the present invention includes a variable compression ratio mechanism that changes the engine compression ratio in accordance with the rotation angle of a first control shaft, an actuator that changes or holds the rotation angle of the first control shaft, and a connecting mechanism that couples the actuator and the first control shaft. This connecting mechanism in turn includes a second control shaft generally disposed in parallel to the first control shaft and a lever coupling the first control shaft and the second control shaft. One end of the lever is coupled to a tip of a first arm portion extending radially outwardly from the center of the first shaft on the one hand, while the other end of the lever is coupled to a tip of a second arm portion extending radially outwardly from the center of the second shaft on the other. The engine compression ratio is configured to be higher along with the rotation of the first control shaft in a higher compression ratio Further, at the setting of minimum compression ratio with a minimum engine compression ratio, the speed reduction ratio from the actuator to the first control shaft through the rotation power transmission line is made maximum, and the speed reduction ratio becomes minimum at the setting of a predetermined intermediate compression ratio. Moreover, at the setting of the engine compression ratio being maximum, the speed reduction ratio is set to be greater than at the setting of intermediate compression ratio.

In addition, when torque is applied about the first control shaft, the load acting on the lever is set to be the maximum at the setting of maximum compression ratio, and the load assumes minimum within a predetermined range between the minimum compression ratio and the intermediate compression ratio.

In other words, when the rotation angle range of the first control shaft is grouped into two regions comprised of a high compression ratio region and a low compression ratio region with a lower compression ratio than the high pressure compression region, the speed reduction ratio is set to be minimum in the high compression ratio region while the load acting on the lever in response to load applied about the first control shaft is set be minimum with respect to the low compression ratio region.

According to the present invention described above, at the setting of minimum compression ratio on a high load side, although the combustion load and inertial load increase due to high load, since the speed reduction ratio is set to be the maximum, the engine compression ratio with a high speed reduction ratio may be held. Further, since the load acting on the lever from the control shaft is set smaller compared in the high compression ratio, while enhancing retention of the first control shaft to suppress the retention torque by the actuator, compactness of the actuator and reduction of consumption energy may be achieved.

Moreover, at rapid acceleration from the low-load at the maximum compression ratio setting, for example, delay in change in the rotation angle toward the low compression ratio of the first control shaft might cause a transient knocking or torque shock due to excessive torque. According to the present invention, however, the speed reduction ratio is set to be minimum at the setting of intermediate compression ratio. Thus, upon rapid acceleration, when rotating the first control shaft from the setting of maximum engine compression ratio in the direction of low compression ratio, the speed reduction ratio will decrease in accordance with the engine compression ratio decrease from the maximum to the intermediate compression ratio. Therefore, the rotation speed of the first control shaft may be increased to thereby improving its responsiveness.

Therefore, by optimizing the relationship between the engine compression ratio and speed reduction ratio, both of which are subject to change in accordance with the rotation angle of the first control shaft, the rotation angle of the control shaft is retained and thereby retentions of engine compression ratio may be improved while responsiveness in the engine compression ratio may be improved.

BRIEF DESCRIPTION OF THE DRAWINGS

Referring now to the attached drawings which form a part of this original disclosure.

DETAILED DESCRIPTION OF THE EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
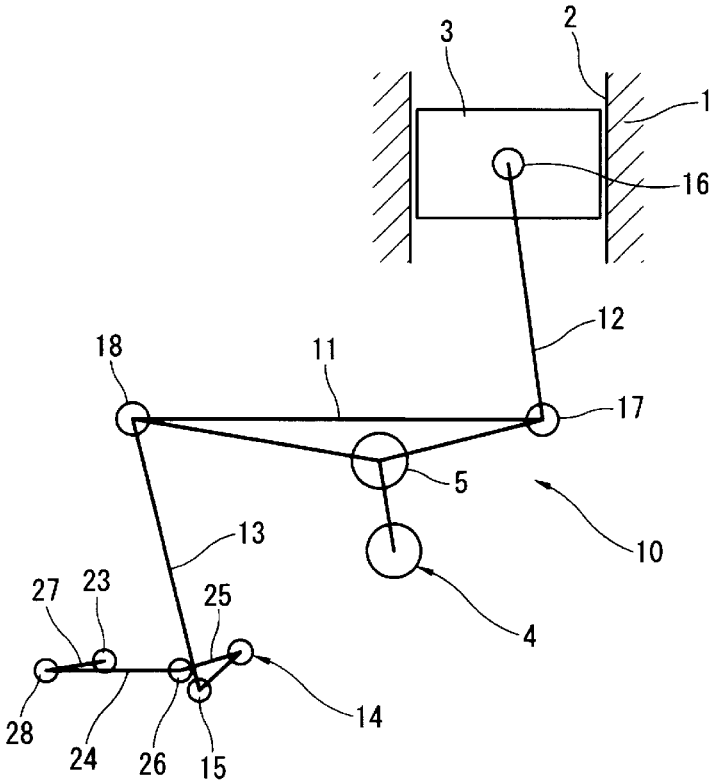
FIG. 1 is a simplified skeleton diagram showing an example of a variable compression ratio mechanism according to the present invention.

First, with reference to FIG. 1, an example of the variable compression ratio mechanism using a multi-link, piston-crank mechanism is described. Details of this mechanism is known and described in the U.S. Patent Application Publication, No. 2004/0163614 A1, which is incorporated herein by reference in its entirety.

In a cylinder block 1 constituting a part of the body of the internal combustion engine, a piston 3 is slidably fitted in each cylinder 2 and a crank shaft 4 is rotatably supported. A variable compression ration mechanism 10 is provided with a lower link 11 rotatably mounted to a crank pin 5 of the crank shaft 4, an upper link 12 connecting the lower link 11 and piston 3, a first control axis or shaft 14 rotatably supported on the engine body such as cylinder block 11 or the like, an eccentric shaft portion 15 mounted eccentrically to the first control shaft 14, a control link 13 connecting this eccentric shaft 15 and lower link 11. The piston 3 and the upper end of upper link 12 are connected via piston pin 16 to be rotatable to each other. The lower end of the upper link 12 and lower link 11 are connected rotatably to each other via upper link connecting pin 17. The upper end of the control link 13 and the lower link 11 are connected to each other rotatably through a control link connecting pin 18 while the lower end of control link 13 is mounted rotatably to the eccentric shaft portion 15.

Figure 2:
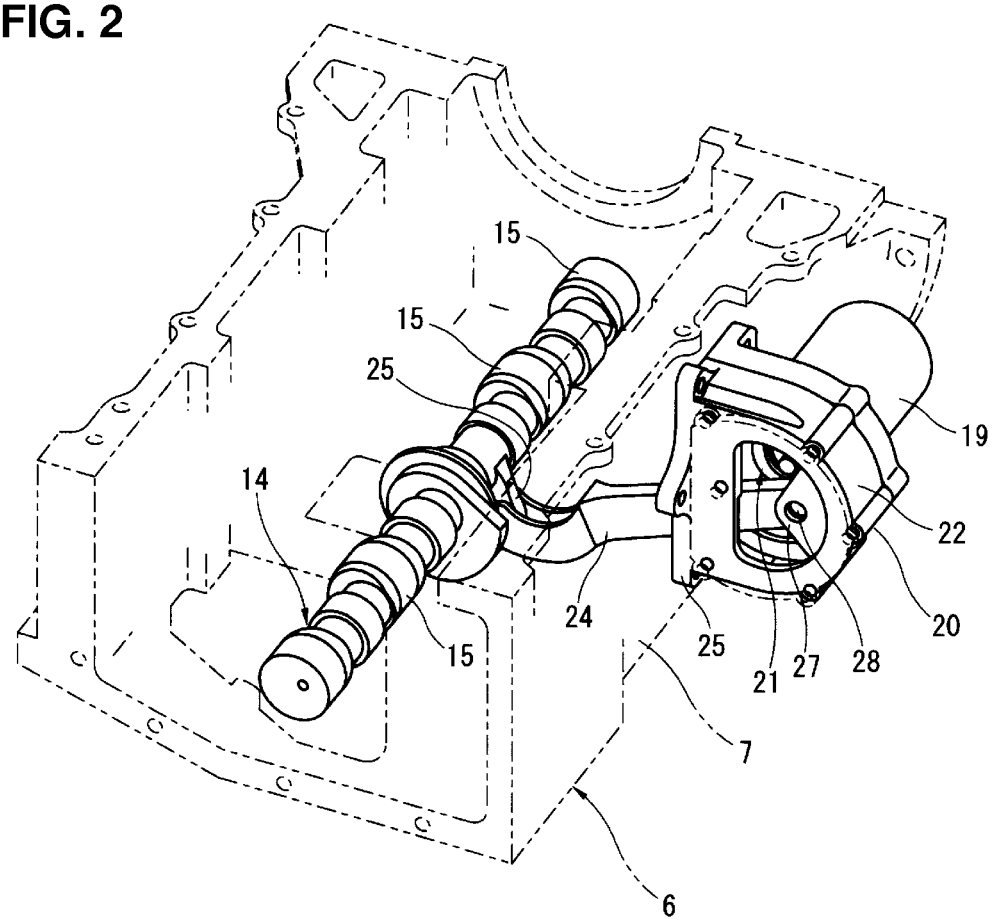
FIG. 2 is a perspective view showing a connecting mechanism which connects the first control shaft and a motor.
Figure 3:
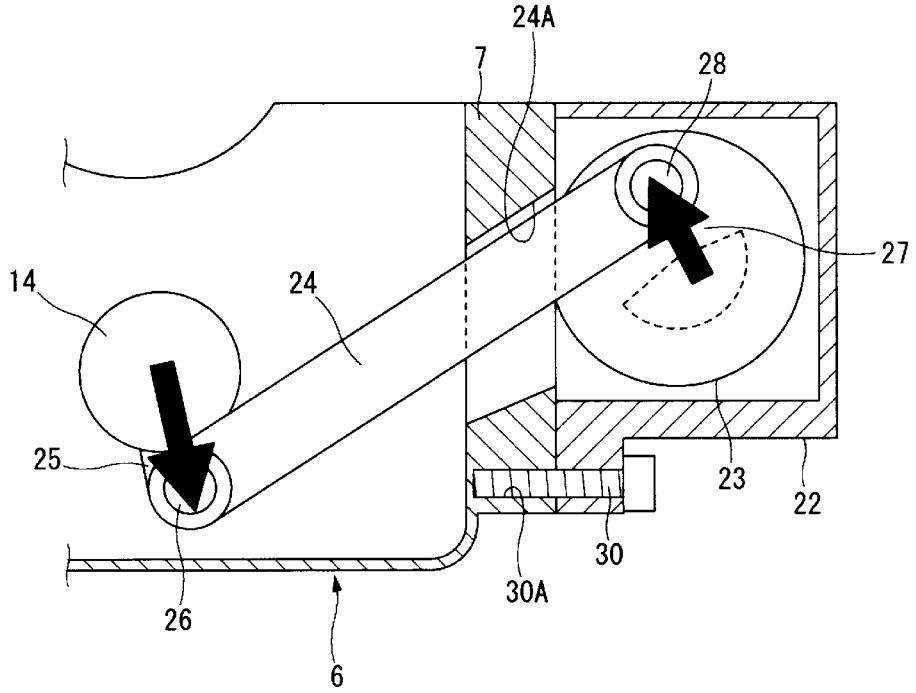
FIG. 3 is a partial cross-sectional view showing a connecting structure between a first control shaft and a second control shaft.

Referring to FIGS. 1 to 3, the first control shaft 14 is connected to an electric motor 19 as an actuator of this variable compression ration mechanism 10 via connecting mechanism 20 having a speed reduction unit 21. By changing the rotation position (angle) of the first control shaft 14 by this motor 19, along with change in posture of lower link 11, a piston stroke characteristic including a piston top end position as well as a piston bottom end position will change, and thereby engine compression ratio will also change. Note that, the actuator is not limited to an electric motor 19, but an actuator of hydraulically driven type may also be employed.

The first control shaft 11 is rotatably supported inside of the engine body constituted by a cylinder block 1 and an oil pan-upper 6 and the like affixed to the bottom surface of the cylinder block 1. On the other hand, the motor 19 is disposed outside of the engine body. More specifically, motor 19 is mounted rearward of a housing 22 which is mounted to a side wall of oil pan-upper 6 on an air intake side (referred to "oil pan side wall") making up a part of the engine body.

A speed reduction unit 21 is configured to reduce rotation of the output shaft of motor 19 to transfer to the first control shaft 14, and incorporates a structure making use of a harmonic drive mechanism (registered trademark). Reference should be made to the above identified U.S. Patent Application Publication, No. 2004/0163614 A1 for more details. The speed reduction unit is not limited to this harmonic drive mechanism, but other tope of speed reduction mechanism may be used such as a cycloidal reduction gear.

The coupling or connecting mechanism 20 is provided with a second control shaft 23 representative of output shaft of the speed reduction unit 21. This second control shaft 23 is rotatably accommodated within housing 22 attached to the oil pan side wall 7, and extends along the oil pan side wall 7 in the longitudinal direction (i.e. in the direction parallel to the first control shaft 11). The first control shaft 14 disposed inside the engine body in which lubricant oil is scattered and the second control shaft 23 disposed outside the engine body are mechanically coupled by a lever 24 passing through the oil pan side wall 7 so that both components are operable to rotate in conjunction. It should be noted that, as shown in FIG. 3, a slit 24A is formed in the oil pan side wall 7 for allowing the lever to pass through, and the housing 22 is attached to the oil pan side wall 7 to cover this slit 24A.

As shown in FIGS. 1, 3, and etc., one end of the lever 24 is connected via a first connecting pin 26 to a tip of the first arm portion 25 extending radially outwardly from the center of the first shaft 14. The other end of the lever 14 is connected via a second connecting pin 28 to a tip of the second arm portion 27 extending radially outwardly from the center of the second shaft 23

By way of this link structure, when rotating the first control shaft 14, along with change in engine compression ratio, due to change in posture of the first arm portion 25, second arm portion 27, and lever 24, the speed reduction ratio from motor 19 to the first control shaft 14 through rotation torque transmission line is also changed.

Thus, in the embodiment described below, by optimizing the relationship between the engine compression ratio and speed reduction ratio, both of which are subject to change in accordance with the rotation angle of the first control shaft 14, retention of engine compression ratio may be improved while responsiveness of the engine compression ratio may also be improved.

Figure 6A:
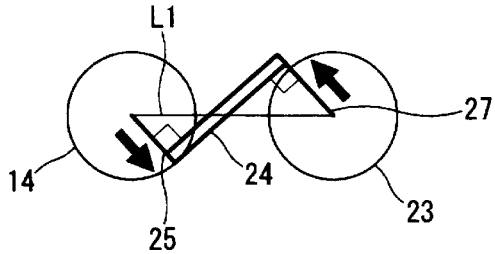
FIGS. 6A and 6B are explanatory diagrams showing arrangements in which the projecting directions of the first arm portion and that of the second arm portion are opposite (FIG. 6A), and the projecting direction of the first arm portion and that of the second arm portion are the same (FIG. 6B)

Referring now to FIG. 4, reference sign H1 denote the characteristic in a first comparative example, reference H2 denotes the characteristic in a second comparative example, and reference Z1 denotes the characteristic in the first embodiment. In each of examples H1, H2, and Z1, as shown in FIG. 6A, the projecting direction of the first arm portion 25 and that of the second arm portion 27 are arranged to be opposite to each other with respect a straight line L1 passing through the center of first control shaft 14 and the center of the second control shaft 23. On the other hand, regarding the length of lever 24 (link length), the length H1 in the first comparative example is shorter than the length of lever 24B (see FIGS. 6, 7, etc.) in a hypothetical link configuration in which lever 24 extends perpendicular to both the first and second arm portions 25, 27, while the length in the second comparative example H2 is the same, and finally the length in the first embodiment is longer in the first embodiment, respectively.

Figure 4A:
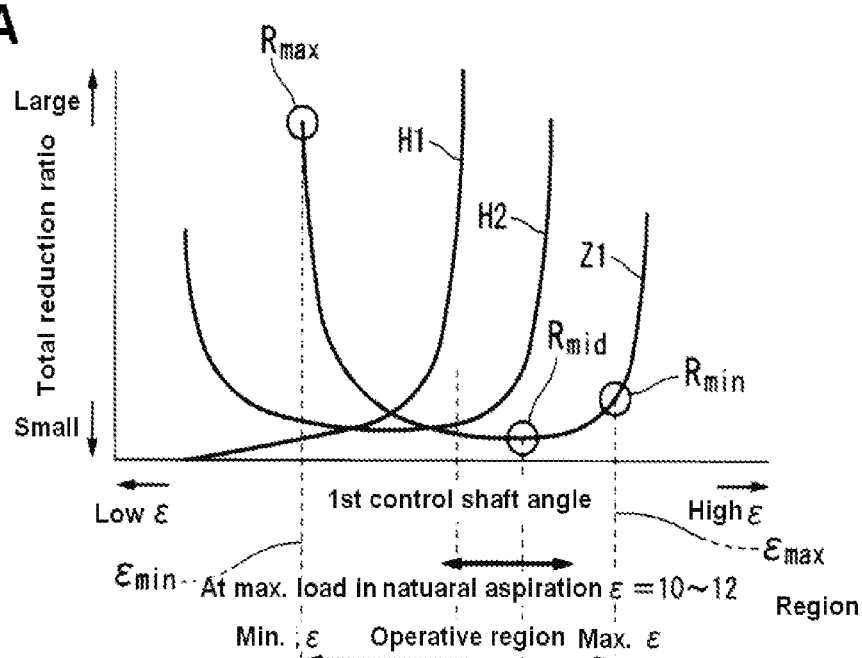
FIG. 4A is an explanatory diagram showing the relationship between the total reduction ratio with respect to rotation angle of the first control shaft in a first embodiment to which the present invention is applied.

As shown in FIG. 4A, in the first embodiment Z1, at the setting of lowest engine compression ratio ϵmin, the total reduction ratio from the driving side motor 19 to the first control shaft 14 on the driven side through a rotation power transmission path is set to assume maximum speed reduction ratio Rmax. Further at a preset intermediate compression ratio ϵmid, more specifically, at the setting of ϵmid used at maximum load (NA-WOT) during a natural inspiration in the internal combustion engine with a turbocharger, speed reduction ratio is configured to be minimum, Rmin. Still further, at the setting of the maximum compression ratio, ϵmax, the speed reduction ratio is set at an intermediate reduction ratio Rmid, that is larger than the minimum reduction ratio Rmin and less than the maximum reduction ratio Rmax. Stated another way, it is configured that, as showing FIG. 4A, the reduction ratio is at a minimum, Rmin at the intermediate compression ratio ϵmid., and as the compression ratio departs from this intermediate compression ratio ϵmid either to higher compression ratio or lower compression ratio, the speed reduction ratio gradually increases, and reaches the maximum reduction ratio Rmax on the side of lower compression ratio.

Figure 4B:
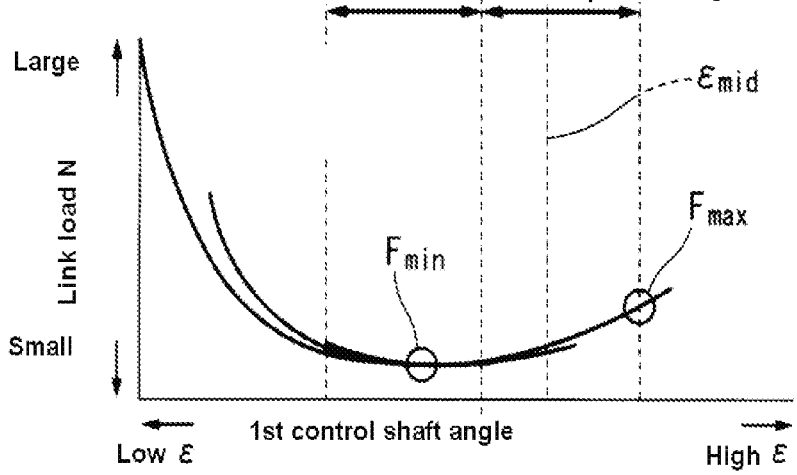
FIG. 4B is an explanatory diagram showing the relationship between the link load with respect to rotation angle of the first control shaft.

In addition, as shown in FIG. 4B, when torque (unit load torque) in the rotation direction about the first control shaft 14 is applied, it is configured that the load (link load) acting on lever 24 becomes the maximum load Fmax at the maximum compression ratio ϵmax, and becomes the minimum load Fmin in a set range between the minimum compression ratio ϵmin and the intermediate compression ϵmid. Stated another way, as shown in FIG. 4B, the link layout is configured in such a way that the load acting on lever 24 from the first control shaft 14 ϵmid becomes the minimum load Fmin at the intermediate compression ratio, and as the compression ratio departs from this intermediate compression ratio in either a higher compression ratio or lower compression ratio, the load gradually increases, and reaches the maximum load Fmax on the higher compression side.

According to the first embodiment, such as the one described above, in the setting state of the low compression ratio, including at the setting of minimum compression ratio ϵmin to be used in the high load region, although large combustion load and inertia load are applied to the first control shaft 14 due to large load, since the speed reduction ratio is set to be maximum Rmax at the minimum compression ratio ϵmin, the rotation position of the first control shaft 14 may be retained or held at a large speed reduction ratio. Further, as shown in FIG. 4B, since the load acting on lever 24 from the first control shat 14 may be set to assume the small value in the vicinity of the minimum load Fmin, the retention torque of the actuator by motor 19 may be decreased. Therefore, load torque of motor 19 and speed reduction mechanism 21 may be reduced, and along with compactness and improvement in durability, overheating of motor 19 may be suppressed or prevented by suppressing the retention power of the motor 19.

On the other hand, at the setting of high compression ratio including maximum compression ratio ϵmax to be used in low load region, since the maximum in-cylinder pressure (maximum combustion load) is lower compared to high load region so as to prevent knocking from occurring, compared at the setting of lower compression ratio to be used at high load, the torque acting on the first control shaft 14 becomes small, and the torque necessary to hold the compression ratio is small, speed reduction ratio will be set at Rmid that is less than the maximum speed Rmax.

Further, it is configured that at the setting of intermediate compression ratio to be used at the maximum load under natural aspiration (NA-WOT), the reduction ratio becomes to be minimum reduction ratio Rmin. In other words, the reduction ratio is set lower than at maximum compression ratio ϵmax. Therefore, at a rapid acceleration from low load region, and when rotating the first control shaft 14 in the direction of lower compression ratio from the setting state of maximum compression ration emax, the reduction ratio will decrease toward the minimum reduction ration Rmin at the intermediate compression ratio ϵmid. The rotation speed of the first control shaft 14 toward the lower compression ratio, i.e., decreasing speed in engine compression ratio, thereby the responsiveness to the lower compression ratio may be increased. If the decrease speed toward the lower compression ratio is slow and the desired response toward the lower compression ratio is not available, due to the need to avoid knocking occurrence by increasing ignition retard or reducing air amount, the torque is reduced. However, in the present embodiment, by enhancing responsiveness toward the lower compression ratio, such torque reduction may be suppressed while suppressing or preventing knocking from occurring.

The configuration which produces the operations and effects described above is attributable to the following. In the first embodiment as shown in FIG. 4, when the operative regions of the engine compression ratio is divided equally into two regions, i.e. a high compression ratio (ϵ) region and a low compression ratio (ϵ) region lower than the high compression region, the minimum speed reduction ratio Rmin is set to be available in the high compression ratio region while in the low compression ratio region the load acting on the lever represents the minimum Fmin during the first control shaft 14 being applied with torque.

Figure 5:
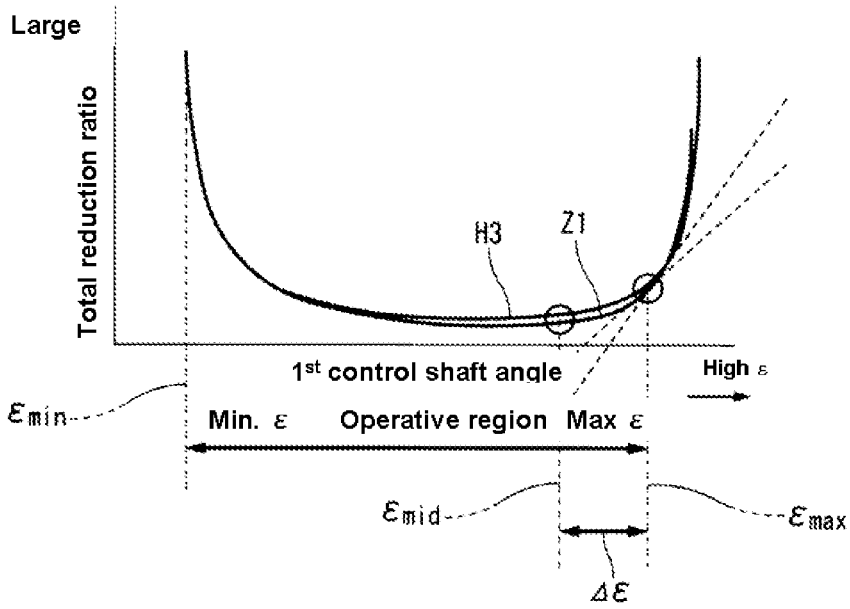
FIG. 5 is an explanatory diagram showing change in the total speed reduction ratio with respect to the rotation angle of the first control shaft in the first embodiment.
Figure 6B:
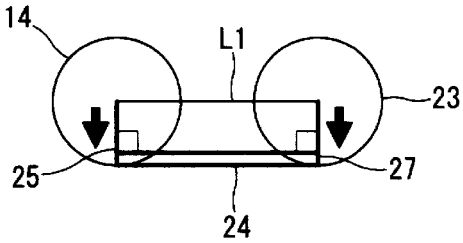

Referring now to FIG. 5, reference sign Z1 denotes the first embodiment described above while reference H3 denotes a third comparative example. In the third comparative example, as shown in FIG. 6B, with respect to a straight line passing through the center of the first control shaft 14 and the center of the second control shaft 23, the projecting direction of the first arm portion 25 and the projecting direction of the second arm portion 27 are set in the same direction or orientation. Further, in both the first embodiment Z1 and the third comparative example H3, the length of the lever 24 is set to be longer than a lever 24B in a hypothetical layout in which lever 24 crosses both the first and second arm portions 25, 27 at right angles.

In the first embodiment Z1, as compared to the third embodiment H3, within a set range $\Delta\epsilon$ between the maximum compression ratio $\epsilon$max and the intermediate compression ratio $\epsilon$mid corresponding to the maximum speed reduction ratio, the projecting direction of the second arm portion 27 is configured with respect the projecting direction of the first arm portion 25 in such a way that the amount of decrease in the reduction ratio in accordance with decrease in the engine compression ratio is greater. In other words, when observing the slope or inclination of the decrease in reduction ratio with respect to the decrease in compression ratio, the inclination K1 in the first embodiment Z1 is steeper than the inclination K2 in the third comparative example H3. More specifically, in this first embodiment Z1, as shown in FIG. 6A, the projecting direction is the same for both the first and second arm portions 25, 27.

Thus, in the first embodiment Z1 in which the projecting directions of the first and second arm portions 25, 27 are opposite to each other, as compared to the third comparative example H3 in which the projecting directions of the first and second arm portions 25, 27 are the same, at rapid acceleration from the setting state of maximum compression ratio $\epsilon$max, a great amount of decrease in reduction ratio with respect to decrease in compression ratio is obtained. Stated another way, due to a rapid decrease in reduction ratio, the decrease speed of compression ratio will be even more facilitated, and the responsiveness toward the lower compression ratio will be further improved. In addition, since the reduction ratio at the setting state of the maximum compression ratio $\epsilon$max is relatively high, the retention torque to hold the compression ratio at the setting state of the maximum compression ratio $\epsilon$max may be alleviated to further lessen consumption power of the motor 19.

Moreover, in the first embodiment Z1 shown in FIG. 6A, when the projecting directions of the first and second arm protons 25, 27 are opposite to each other, compared to the third comparative example H3 in which the projecting directions of the first and second arm portions 25, 27 are the same, because of short length of lever 24, the rigidity of lever 24 may be increased, and thereby the occurrence of resonance accompanied by elastic deformation may be suppressed with reduced size and weight.

Further, since it is set up in such a way that a maximum combustion load is applied in the compression direction of the lever 24 in the first embodiment Z1, by reducing the length of the lever 24, the cross-sectional area of the lever 24 can be reduced without undergoing buckling. Thus, without causing interference of the first and second arm portions 25, 27 with lever 24, the angle of nip between both components can be made small so that the width or range of the variable compression ratio may be enlarged.

Figure 7A:
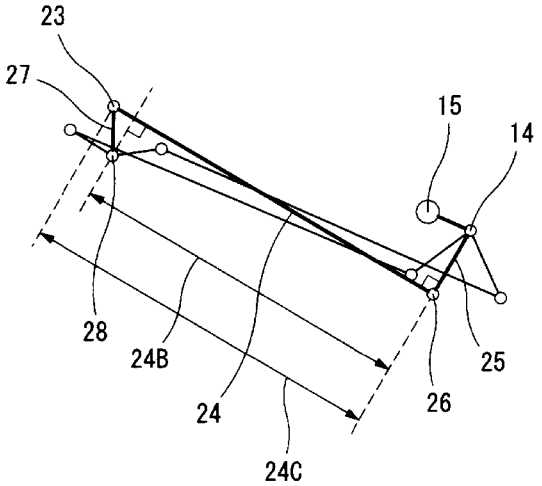
FIGS. 7A and 7B are explanatory diagrams showing a link configuration in the first embodiment according to the present invention.

Referring to FIG. 7, the specific link configuration of the first embodiment Z1 that may provide the above-described operations and effects is now described. In the first embodiment Z1, as described above, the length 24C (link length) of lever 24 is set to be longer than the length of a lever 24B that would cross both the first and second arms 25, 27 with right angles. In other words, as shown in FIG. 7A, when one of the first arm portion 25 and second arm portion 27 would cross lever 24 at right angles, the length 24C of lever 24 is set up in such a way that the angle that is formed by the other of the first and second arm portions 25, 27 and the lever 24 represents an acute angle.

Figure 7B:
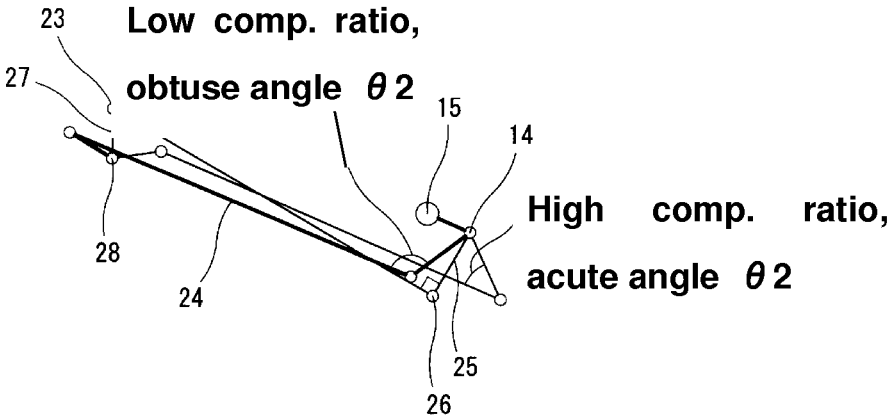

Further, as shown in FIG. 7B, the angle formed by lever 24 and the first arum portion 25 is set up in such a way to represent obtuse angle $\theta$1 at setting up of low compression ratio in the vicinity of minimum compression ratio $\epsilon$min while to represent acute angle $\theta$2 at the setting of high compression ratio in the vicinity of maximum compression ratio max. In addition, the eccentric shaft portion 15 of the first control shaft 14 is disposed on the side closer to the center of the second control shaft 23 with respect to the center of first control shaft 14.

Figure 8A:
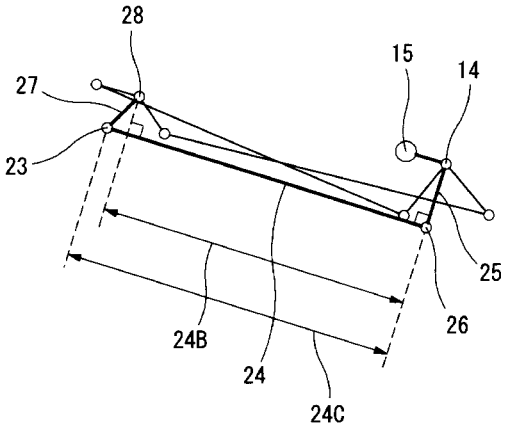
FIGS. 8A and 8B are explanatory diagrams showing a link configuration in a second embodiment according to the present invention.
Figure 8B:
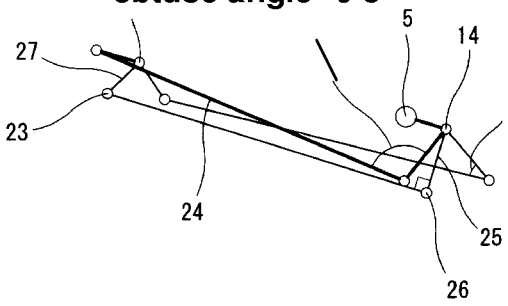

FIG. 8 shows a link configuration that produces the similar operations and effects in the second embodiment Z2 as in the first embodiment Z1. The second embodiment Z2 differs from the first embodiment Z1 shown in FIG. 7 in that the projecting directions of the first and second arm portions 25, 27 are the same. As shown in FIG. 8A, the length 24C of lever 24 is set to be longer than the length 24B of lever 24 that would cross both the first and second arm portions 25, 27 at right angles, as in the first embodiment. Stated another way, the length 24C of lever 24 is set up in such a way that, when one of the first and second arm portions 25 and 27 crosses lever 24 at right angles, the angle formed by the other of the first and second arm portions and lever 24 represents an acute angle.

Further, similarly in the first embodiment, the angle formed by lever 24 and the first arum portion 25 is set up to represent obtuse angle $\theta$3 of at the setting of low compression ratio while to represent acute angle $\theta$2 at the setting up of high compression ratio. In addition, the eccentric shaft portion 15 of the first control shaft 14 is disposed on the side closer to the center of the second control shaft 23 with respect to the center of first control shaft 14.

Figure 9A:
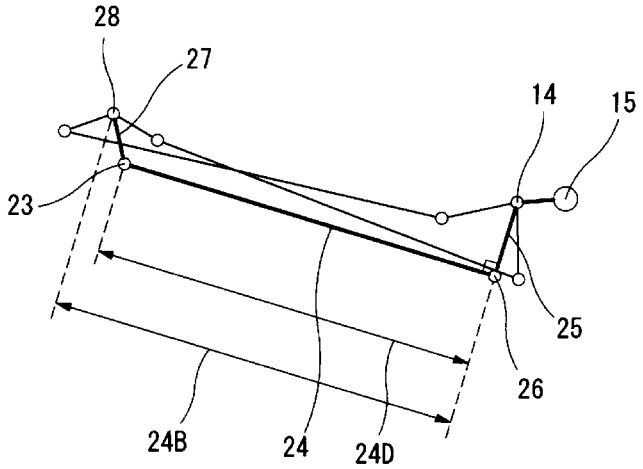
FIGS. 9A and 9B are explanatory diagrams showing a link configuration in a third embodiment according to the present invention.

FIG. 9 shows a link configuration that produces the similar operations and effects in the third embodiment Z3 as in the first embodiment Z1. The third embodiment Z3 differs from the first embodiment Z1 in that the length 24D of lever 24 is set to be shorter than the length 24B of lever 24 that would cross the first and second arm portions 25, 27 at right angles. Stated another way, as shown in FIG. 9A, the length 24D of lever 24 is set up in such a way that, when one of the first and second arm portions 25 and 27 crosses lever 24 at right angles, the angle formed by the other of the first and second arm portions and lever 24 represents an obtuse angle.

Figure 9B:
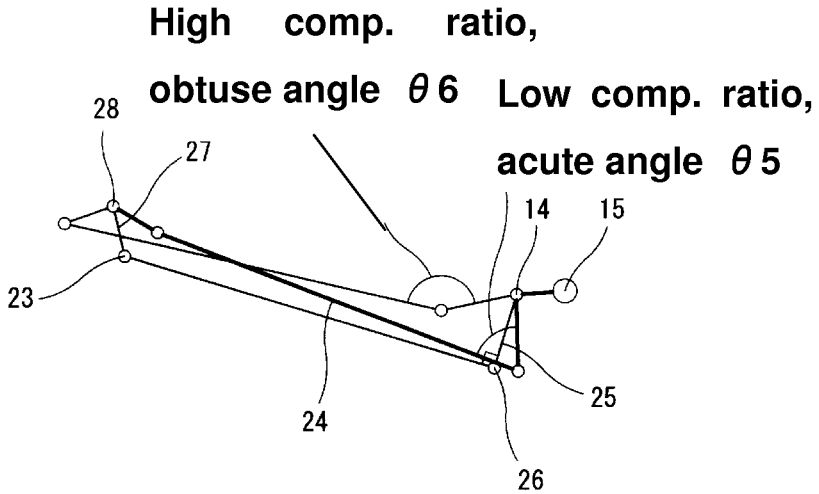

Further, as shown in FIG. 9B, the angle formed by lever 24 and the first arum portion 25 is set up to represent acute angle $\theta$5 at the setting of low compression ratio while to represent obtuse angle $\theta$6 at the setting of high compression ratio. In addition, the eccentric shaft portion 15 of the first control shaft 14 is disposed on the side distant from the center of the second control shaft 23 with respect to the center of first control shaft 14.

Figure 10A:
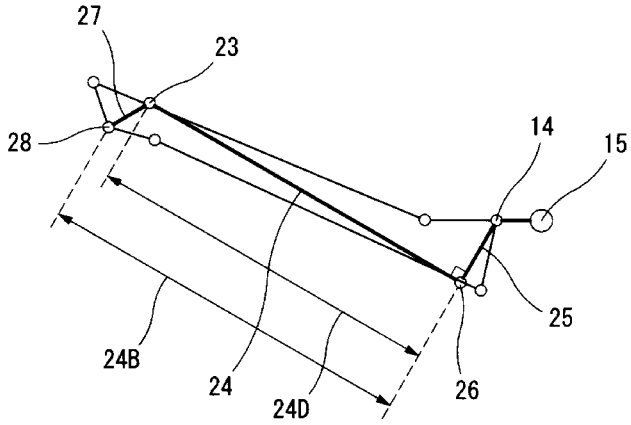
FIGS. 10A and 10B are explanatory diagrams showing a link configuration in a fourth embodiment according to the present invention.

A fourth embodiment Z4 shown in FIG. 10 differs from the third embodiment Z3 in that the projecting directions of the first and second arm portions 25, 27 are in the same direction. As shown in FIG. 10A, the length 24D is set similarly in the third embodiment Z3 so as to be shorter than the length 24B of lever 24 that would cross both the first and second arm portions 25,27 at right angles in a hypothetical layout. Stated another way, the length 24D of lever 24 is set in such a way that, when one of the first and second arm portions 25, 27 crosses lever 24 at right angles, the angle formed by the other of the first and second portions 25, 27 and the leer 24 represents an obtuse angle.

Figure 10B:
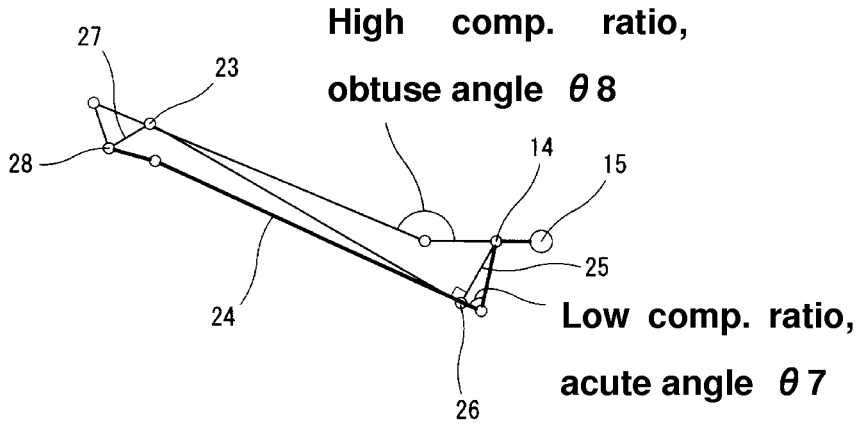

Further, as shown in FIG. 10B, the angle formed by lever 24 and the first arm portion 25 is set to be an acute angle θ7 at low compression ratio while an obtuse angle θ8 at high compression ratio.

Figure 11:
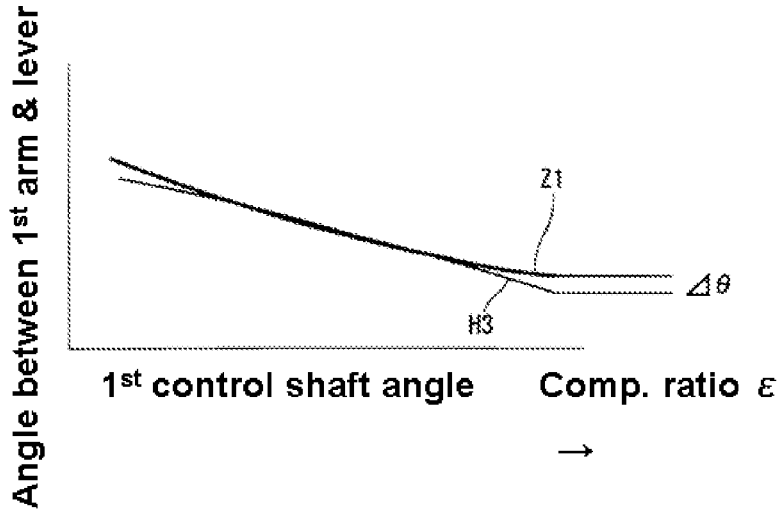
FIG. 11 is an explanatory diagram showing change in an angle formed by the first arm portion and a lever with respect to rotation angle of the first control shaft pertaining to the first embodiment.

FIG. 11 is a characteristic diagram showing the angle formed by the first arm portion 25 and lever 24 with respect to the angle of the first control shaft 14 (i.e. setting of engine compression ratio). As described above, in the first embodiment Z1, as shown in FIG. 6A, with respect to a straight line L1 passing through the center of the first control shaft 14 and the center of the second control shaft 23, the projecting directions of the first and second arm portions 25, 27 are set to be opposite to each other. In contrast, in the third comparative example H3, as shown in FIG. 6B, with respect to the straight line L1 passing through the center of the first arm portion 25 and the center of second arm portion 27 are the same.

As shown in FIG. 11, in the first embodiment in which the projecting directions of the first and second arm portions 25, 27 are set to be opposite to each other, as compared to the third comparative example H3 in which the projecting directions of the first and second arm portions are the same, the minimum value of the angle formed by the first arm portion 25 and lever 24 will be larger by Δθ. Thus, it is easy to avoid the interference between lever 24 and the first arm portion 25 so that a sufficient cross-area of lever 24 may be secured to achieve the purported strength and rigidity without causing the interference there between.

Figure 12:
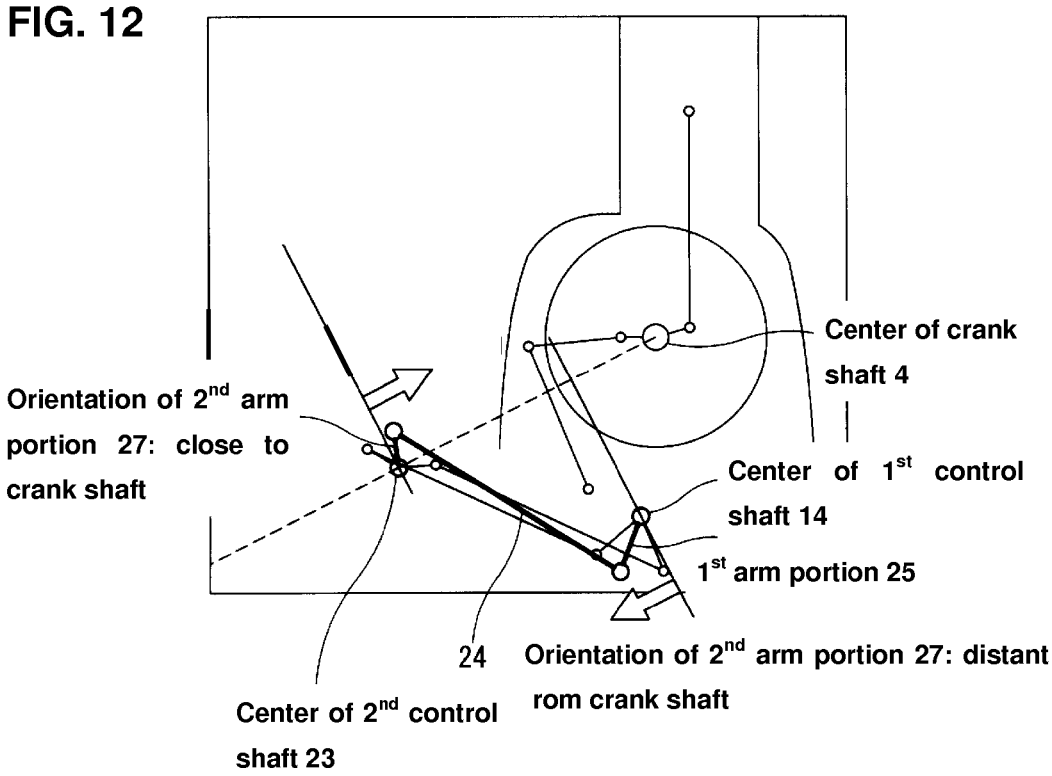
FIG. 12 an explanatory diagram showing a link configuration in a fifth embodiment.

FIG. 12 shows a link configuration pertaining to a fifth embodiment according to the present invention. Here, the projecting direction of the first arm portion 25 with respect to the center of the first control shaft 14 is set in a direction away from the center of the crank shaft 4, and, the projecting direction of the second arm portion 27 with respect to the center of the second control shaft 23 is set in a direction close to the center of the crank shaft 4. In other words, the projecting direction of the first arm portion 25 is set to be downward while the projecting direction of the second arm portion 27 is upward.

By this configuration, as shown in FIG. 3, as well, the height of the slit 24A formed in the side wall 7 of oil pan for inserting lever 24 may be placed at the central portion in the vertical direction of the housing 22 which is disposed obliquely above the first control shaft 14. Stated another way, as compared to the case in which the projecting directions of the first and second arm portions 25, 27 are both directed downward, the height direction of slit 24A may be disposed above. Consequently, the weight of the oil pan may be reduced due to shortening of the vertical dimension of the oil pan-upper 6 along with securing a sufficient ground level of the oil pan and housing 22. Also, the vertical dimension of the actuator, i.e. motor 19 may be reduced in size and weight.

In addition, it is also possible to arrange fastening bolts 30 for mounting the housing 22 to oil pan side wall 7 are arranged on the lower side of the slit 24A, and thus a plurality of fastening bolts 30 may be disposed above and below the silt 24A, with placing the slit 24A in the central portion of the fastening bolts 30. Therefore, it is possible to suppress a decrease in the surface pressure of fastening bolts in the vicinity of the slit 24A with improved oil seal.

Moreover, since the trajectory of the lever 24 is positioned in central vertical area of the housing 22, it is possible to dispose female screw portion 30A of fastening bolt 30 on the lower side of housing 22, and the slit 24A may be positioned spaced apart from each other in the vertical direction. Thus, the interference between the two components is avoided, and housing 22 may be placed proximate to oil pan, so that the amount of protrusion by the actuator from the oil pan may be reduced to improve onboard installation in vehicle.

In addition, compared with the case in which the projecting directions of the first and second arm portions 25, 27 are set downwardly, since the slit 24A can be placed relatively upward, more specifically above the center of the first control shaft 14, the oil level in the housing 22 may be set independently of the oil level in the oil pan. Consequently, the amount of oil supply to the connecting mechanism in the housing including the speed reduction unit 21 (or oil reservoir amount in the housing 22) may be suitably adjusted for improving above the lubricity.

Figure 13:
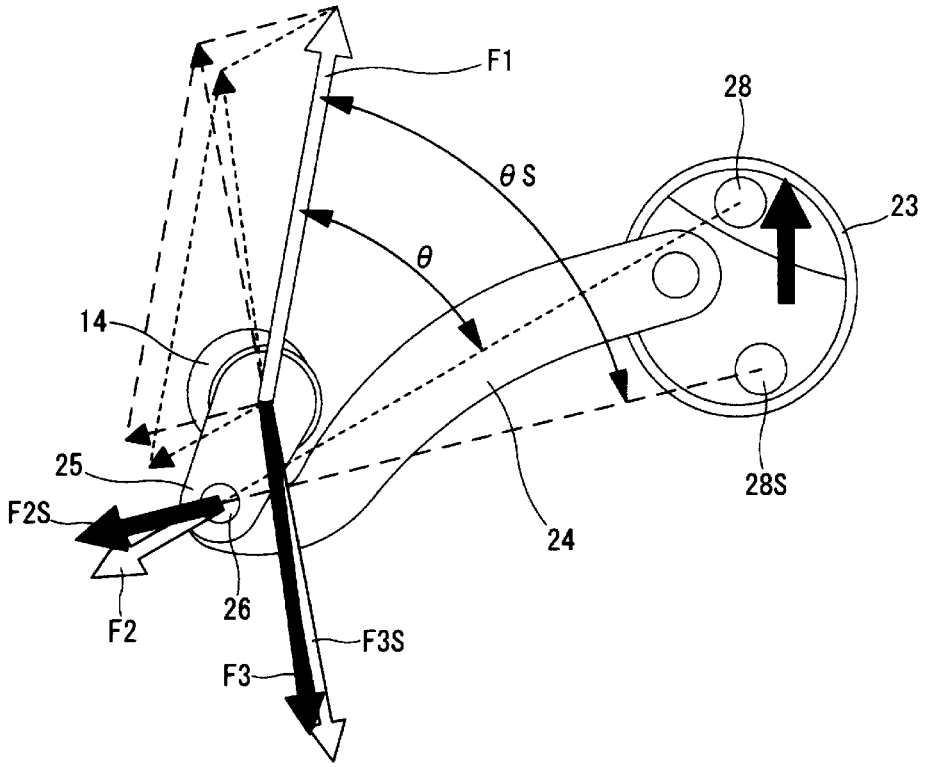
FIG. 13 an explanatory diagram showing a link configuration as well as the applied load in the fifth embodiment.

FIG. 13 is an explanatory diagram showing operation of load with respect to the fifth embodiment Z5 in which the projecting direction of the second arm 27 is set opposite to the projecting direction of the first arm portion 25 as compared to the comparative example in which both the first and second arm portions 25, 27 are directed downward in the layout of the housing 22 being disposed on the side of the oil pan side wall 7. Note that suffix "S" is attached followed by reference sign to those related to the comparative example. The load F3, F3S acting on the main axis portion of the first control shaft 14 corresponds to the resultant force of load F1 acting on the eccentric shaft portion 15 of the first control shaft 14 from control link 13 and the load F2, F2S acting on the first arm portion 25 of the first control shaft 14 from lever 24. As shown in the Figure, in the fifth embodiment, as compared to the comparative example, since the angle formed by the link center line of lever 24 and the direction of action of load F1 is small (θ<θS), the load acting on the main axis portion of first control shaft 14 is suppressed to small (F3<F3S). Consequently, the wear of main axis portion of first control shaft 14 may be reduced, which contributes to reduce the friction of the main axis portion of the first control 4 thereby improving the responsiveness to change in the compression ratio.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A variable compression ratio engine comprising:

a variable compression ratio mechanism that changes an engine compression ratio in accordance with a rotation position of a first control shaft;

an actuator that selectively changes and holds the rotation position of the first control shaft;

a connecting mechanism that couples the actuator and the first control shaft, the connecting mechanism including a second control shaft disposed generally parallel to the first control shaft and a lever connecting the first control shaft and the second control shaft, wherein one end of the lever is connected to a tip of a first arm portion extending radially outwardly of a center of the first control shaft while another end of the lever is connected to a tip of a second arm portion extending radially outwardly of the center of the second control shaft;

the engine compression ratio is set to be higher as the first control shaft rotates in a direction of a predetermined high compression ratio;

a speed reduction ratio from the actuator to the first control shaft through a rotation power transmission path is at a maximum when the engine compression ratio is at a minimum compression ratio;

the speed reduction ratio is at a minimum at an intermediate compression ratio;

the speed reduction ratio is set greater when the engine compression ratio is at the maximum than at the intermediate compression ratio; and a load acting on the lever upon torque being applied about the first control shaft is set to be a maximum at the maximum compression ratio and is at the minimum within a set range between the minimum compression ratio and the intermediate compression ratio, wherein, between the maximum compression ratio and the intermediate compression ratio, a projecting direction of the second arm portion is set in a direction in which a decrease amount of the speed reduction ratio with respect to a decrease of the engine compression ratio is greater.

2. The variable compression ratio engine as recited in claim 1, wherein a length of the lever is set in such a way that, when one of the first arm portion and the second arm portion crosses the lever at right angles, an angle formed by the other one of the first arm portion and the second arm portion and the lever is an obtuse angle;

an angle formed by the lever and the first arm portion is an acute angle at low compression ratio and is an obtuse angle at high compression ratio, the variable compression ratio mechanism includes a lower link rotatably mounted to a crank pin of the crank shaft, an upper link connecting the lower link and the piston, and a control link connecting the lower link and an eccentric shaft portion of the first control shaft, and wherein an eccentric shaft portion of the first control shaft is disposed on a side distant from the center of the second control shaft with respect to the center of the first control shaft.

3. The variable compression ratio engine as recited in claim 2, wherein the projecting direction with respect to the center of the first control shaft is a direction away from the center of the crank shaft; and the projecting direction of the second arm portion with respect to the center of the second arm is set in a direction approaching the center of the crank shaft.

4. A variable compression ratio engine comprising:

a variable compression ratio mechanism that changes an engine compression ratio in accordance with a rotation position of a first control shaft;

an actuator that selectively changes and holds the rotation position of the first control shaft;

a connecting mechanism that couples the actuator and the first control shaft, the connecting mechanism including a second control shaft disposed parallel to the first control shaft and a lever connecting the first control shaft and the second control shaft, wherein one end of the lever is connected to a tip of a first arm portion extending radially outwardly of a center of the first control shaft while another end of the lever is connected to a tip of a second arm portion extending radially outwardly of a center of the second control shaft;

the engine compression ratio is set to be higher as the first control shaft rotates in a direction of a predetermined high compression ratio;

a speed reduction ratio from the actuator to the first control shaft through a rotational power transmission path is at a maximum when the engine compression ratio is a minimum compression ratio;

the speed reduction ratio is at a minimum at the intermediate compression ratio;

the speed reduction ratio is set greater when the engine compression ratio is at the maximum than at the intermediate compression ratio; and, when a rotation range of the first control shaft is equally divided into a high compression ratio region and a low compression ratio region, a minimum speed reduction ratio is set to be obtained in the high compression ratio while the load acting on the lever in response to a torque acting about the first control shaft is set to be minimal in the low compression ratio region.

5. The variable compression ratio engine as recited in claim 4, wherein, between the maximum compression ratio and the intermediate compression ratio, a projecting direction of the second arm portion is set in a direction in which a decrease amount of the speed reduction ratio with respect to a decrease of the engine compression ratio is greater.

6. A variable compression ratio engine comprising:

a variable compression ratio mechanism that changes an engine compression ratio in accordance with a rotation position of a first control shaft;

an actuator that selectively changes and holds the rotation position of the first control shaft;

a connecting mechanism that couples the actuator and the first control shaft, the connecting mechanism including a second control shaft disposed generally parallel to the first control shaft and a lever connecting the first control shaft and the second control shaft, wherein one end of the lever is connected to a tip of a first arm portion extending radially outwardly of a center of the first control shaft while another end of the lever is connected to a tip of a second arm portion extending radially outwardly of the center of the second control shaft;

the engine compression ratio is set to be higher as the first control shaft rotates in a direction of a predetermined high compression ratio;

a speed reduction ratio from the actuator to the first control shaft through a rotation power transmission path is at a maximum when the engine compression ratio is at a minimum compression ratio;

the speed reduction ratio is at a minimum at an intermediate compression ratio;

the speed reduction ratio is set greater when the engine compression ratio is at the maximum than at the intermediate compression ratio; and a load acting on the lever upon torque being applied about the first control shaft is set to be a maximum at the maximum compression ratio and is at the minimum within a set range between the minimum compression ratio and the intermediate compression ratio, wherein a length of the lever is set in such a way that, when one of the first arm portion and the second arm portion crosses the lever at right angles, an angle formed by the other one of the first arm portion and the second arm portion and the lever is an acute angle;

an angle formed by the lever and the first arm portion is obtuse at low compression ratio while acute at high compression ratio, the variable compression ratio mechanism includes a lower link rotatably mounted to a crank pin of the crank shaft, an upper link connecting the lower link and the piston, and a control link connecting the lower link and an eccentric shaft portion of the first control shaft, and wherein an eccentric shaft portion of the first control shaft is disposed on a side closer to the center of the second control shaft with respect to the center of the first control shaft.

7. The variable compression ratio engine as recited in claim 6, wherein, between the maximum compression ratio and the intermediate compression ratio, a projecting direction of the second arm portion is set in a direction in which a decrease amount of the speed reduction ratio with respect to a decrease of the engine compression ratio is greater.

8. The variable compression ratio engine as recited in claim 6, wherein the projecting directions of the first arm portion and the second arm portion are set to be opposite to each other with respect to a straight line passing through the center of the first control shaft and the center of the second control shaft.

* * * * *